US007895046B2

(12) United States Patent
Andersen et al.

(10) Patent No.: US 7,895,046 B2
(45) Date of Patent: Feb. 22, 2011

(54) LOW BIT RATE CODEC

(75) Inventors: Soren V. Andersen, Aalborg (DK); Roar Hagen, Stockholm (SE); Bastiaan Kleijn, Stocksund (SE)

(73) Assignees: Global IP Solutions, Inc., San Francisco, CA (US); Global IP Solutions (GIPS) AB, Stockholm (SE)

( * ) Notice: Subject to any disclaimer, the term of this patent is extended or adjusted under 35 U.S.C. 154(b) by 1338 days.

(21) Appl. No.: 10/497,530

(22) PCT Filed: Dec. 3, 2002

(86) PCT No.: PCT/SE02/02226

§ 371 (c)(1),
(2), (4) Date: Nov. 30, 2004

(87) PCT Pub. No.: WO03/049081

PCT Pub. Date: Jun. 12, 2003

(65) Prior Publication Data

US 2006/0153286 A1 Jul. 13, 2006

(30) Foreign Application Priority Data

Dec. 4, 2001 (SE) ..... 0104059

(51) Int. Cl.
*G10L 21/04* (2006.01)

(52) U.S. Cl. ..... 704/503; 704/219; 704/500; 704/501; 704/502; 704/504

(58) Field of Classification Search ..... None
See application file for complete search history.

(56) References Cited

U.S. PATENT DOCUMENTS

| | | | | |
|---|---|---|---|---|
| 6,389,388 | B1 * | 5/2002 | Lin | 704/219 |
| 6,970,479 | B2 * | 11/2005 | Abrahamsson et al. | 370/477 |
| 6,973,132 | B2 * | 12/2005 | Sato et al. | 375/240.26 |
| 7,209,878 | B2 * | 4/2007 | Chen | 704/220 |
| 2001/0048680 | A1 * | 12/2001 | Yoshimura et al. | 370/389 |
| 2002/0037049 | A1 * | 3/2002 | Hayashita et al. | 375/240.12 |
| 2003/0063745 | A1 * | 4/2003 | Boykin et al. | 380/200 |

OTHER PUBLICATIONS

Boyce, J.M., "*Packet loss resilient transmission of MPEG video over the Internet*," Signal Processing: Image Communications, Sep. 1999, vol. 15, No. 1-2, pp. 7-24.

(Continued)

*Primary Examiner*—Richemond Dorvil
*Assistant Examiner*—Leonard Saint Cyr
(74) *Attorney, Agent, or Firm*—Birch, Stewart, Kolasch & Birch, LLP

(57) ABSTRACT

The present invention relates to improvements of predictive encoding/decoding operations performed on a signal which is transmitted over a packet switched network. The signal is encoded on a block by block basis in such way that a block A-B is predictive encoded independently of any preceding blocks. A start state (715) located somewhere between the end boundaries A and B of the block is encoded using any applicable coding method. Both block parts surrounding the start state is then predictive encoded based on the start state and in opposite directions with respect to each other, thereby resulting in a full encoded representation (745) of the block A-B. At the decoding end, corresponding decoding operations are performed.

39 Claims, 8 Drawing Sheets

OTHER PUBLICATIONS

Andersen, S.V. et al., "*Multiplexed Predictive Coding of Speech*," In: 2001 IEEE International Conference on Acoustics, Speech, and Signal Processing, 2001. Proceedings. Salt Lake City, UT, USA, Mar. 7-11, 2001, vol. 2, pp. 741-744, ISBN: 0-7803-7041-4.

Leslie, B. et al., "*Packet Loss Resilient, Scalable Audio Compression and Streaming for IP Networks*," In: Second International Conferenece on 3G Mobile Communication Technologies, 2001. (Conf. Publ: No. 477), London, UK, Mar. 26-28, 2001, pp. 119-123, ISBN: 0-85296-731-4.

* cited by examiner

LOW BIT RATE CODEC

TECHNICAL FIELD OF THE INVENTION

The present invention relates to predictive encoding and decoding of a signal, more particularly it relates to predictive encoding and decoding of a signal representing sound, such as speech, audio, or video.

TECHNICAL BACKGROUND AND PRIOR ART

Real-time transmissions over packet switched networks, such as speech, audio, or video over Internet Protocol based networks (mainly the Internet or Intranet networks), has become increasingly attractive due to a number of features. These features include such things as relatively low operating costs, easy integration of new services, and one network for both non-real-time and real-time data. Real-time data, typically a speech, an audio, or a video signal, in packet switched systems is converted into a digital signal, i.e. into a bitstream, which is divided in portions of suitable size in order to be transmitted in data packets over the packet switched network from a transmitter end to a receiver end.

As packet switched networks originally were designed for transmission of non-real-time data, transmissions of real-time data over such networks causes some problems. Data packets can be lost during transmission, as they can be deliberately discarded by the network due to congestion problems or transmission errors. In non-real-time applications this is not a problem since a lost packet can be retransmitted. However, retransmission is not a possible solution for real-time applications that are delay sensitive. A packet that arrives too late to a real-time application cannot be used to reconstruct the corresponding signal since this signal already has been, or should have been, delivered to the receiving end, e.g. for playback by a speaker or for visualization on a display screen. Therefore, a packet that arrives too late is equivalent to a lost packet.

When transferring a real-time signal as packets, the main problem with lost or delayed data packets is the introduction of distortion in the reconstructed signal. The distortion results from the fact that signal segments conveyed by lost or delayed data packets cannot be reconstructed.

When transferring a signal it is most often desired to use as little bandwidth as possible. As is well known, many signals have patterns containing redundancies. Appropriate coding methods can avoid the transmission of the redundant information thereby enabling a more bandwidth effective transmission of the signal. Typical coding methods taking advantage of such redundancies are predictive coding methods. A predictive coding method encodes a signal pattern based on dependencies between the pattern representations. It encodes the signal for transmission with a fixed bit rate and with a tradeoff between the signal quality and the transmitted bit rate. Examples of predictive coding methods used for speech are Linear Predictive Coding (LPC) and Code Excited Linear Prediction (CELP), which both coding methods are well known to a person skilled in the art.

In a predictive coding scheme a coder state is dependent on previously encoded parts of the signal. When using predictive coding in combination with packetization of the encoded signal, a lost packet will lead to error propagation since information on which the predictive coder state at the receiving end is dependent upon will be lost together with the lost packet. This means that decoding of a subsequent packet will start with an incorrect coder state. Thus, the error due to the lost packet will propagate during decoding and reconstruction of the signal.

One way to solve this problem of error propagation is to reset the coder state at the beginning of the encoded signal part included by a packet. However, such a reset of the coder state will lead to a degradation of the quality of the reconstructed signal. Another way of reducing the effect of a lost packet is to use different schemes for including redundancy information when encoding the signal. In this way the coder state after a lost packet can be approximated. However, not only does such a scheme require more bandwidth for transferring the encoded signal, it furthermore only reduces the effect of the lost packet. Since the effect of a lost packet will not be completely eliminated, error propagation will still be present and result in a perceptually lower quality of the reconstructed signal.

Another problem with state of the art predictive coders is the encoding, and following reconstruction, of sudden signal transitions from a relatively very low to a much higher signal level, e.g. during a voicing onset of a speech signal. When coding such transitions it is difficult to make the coder states reflect the sudden transition, and more important, the beginning of the voiced period following the transition. This in turn will lead to a degraded quality of the reconstructed signal at a decoding end.

SUMMARY OF THE INVENTION

An object of the present invention is to overcome at least some of the above-mentioned problems in connection with predictive encoding/decoding of a signal which is transmitted in packets.

Another object is to enable an improved performance at a decoding end in connection with predictive encoding/decoding when a packet with an encoded signal portion transmitted from an encoding end is lost before being received at the decoding end.

Yet another object is to improve the predictive encoding and decoding of a signal which undergoes a sudden increase of its signal power.

According to the present invention, these objects are achieved by methods, apparatuses and computer-readable mediums having the features as defined in the appended claims and representing different aspects of the invention. By way of example, and not limitation, computer readable mediums may comprise computer storage media and communication media. As is well known to a person having ordinary skill in the art, computer storage media includes both volatile and non-volatile, removable and non-removable media implemented in any method or technology for storage of information such as computer readable instructions, data structures, program modules or other data. Computer storage media includes, but is not limited to, RAM, ROM, EEPROM, flash memory or other memory technology, CD-ROM, digital versatile disks (DVD) or other optical disk storage, magnetic cassettes, magnetic tape, magnetic disk storage or other magnetic storage devices, or any other medium which can be used to store the desired information and which can be accessed by a computer. Further, it is known to the skilled person that communication media typically embodies computer readable instructions, data structures, program modules or other data in a modulated data signal such as a carrier wave or other transport mechanism and includes any information delivery media.

According to the invention, a signal is divided into blocks and then encoded, and eventually decoded, on a block by block basis. The idea is to provide predictive encoding/decoding of a block so that the encoding/decoding is independent on any preceding blocks, while still being able to provide predictive encoding/decoding of a beginning end of the block in such way that a corresponding part of the signal can be reproduced with the same level of quality as other parts of the signal. This is achieved by basing the encoding and the decoding of a block on a coded start state located somewhere between the end boundaries of the block. The start state is encoded/decoded using any applicable coding method. A second block part and a third block part, if such a third part is determined to exist, on respective sides of the start state and between the block boundaries are then encoded/decoded using any predictive coding method. To facilitate predictive encoding/decoding of both block parts surrounding the start state, and since encoding/decoding of both of these parts will be based on the same start state, the two block parts are encoded/decoded in opposite directions with respect to each other. For example, the block part located at the end part of the block is encoded/decoded along the signal pattern as it occurs in time, while the other part located at the beginning of the block is encoded/decoded along the signal pattern backwards in time, from later occurring signal pattern to earlier occurring signal pattern.

By encoding the block in three stages in accordance with the invention, coding independency between blocks is achieved and proper predictive encoding/decoding of the beginning end of the block always facilitated. The three encoding stages are:

- Encoding a first part of the block, which encoded part represents an encoded start state.
- Encoding a second block part between the encoded start state and one of the block end boundaries using a predictive coding method which gradually codes this second block part from the start state to the end boundary.
- Determining whether a third block part exists between the encoded start state and the other one of the block end boundaries, and if so, encoding this third block part using a predictive coding method which gradually codes this third block part from the start state to this other end boundary. With respect to a time base associated with the block, the third block part is encoded in an opposite direction in comparison with the encoding of the second block part.

Correspondingly, decoding of an encoded block is performed in three stages when reproducing a corresponding decoded signal block.

- Decoding the encoded start state.
- Decoding an encoded second part of the block. A predictive decoding method based on the start state is used for reproducing the second part of the block located between the start state and one of the two end boundaries of the block.
- Determining whether an encoded third block part exists, and if so, decoding this encoded third part of the block. Again, a predictive decoding method based on the start state is used for reproducing the third part of the block located between the start state and the other one of the two end boundaries of the block. With respect to a time base associated with the reproduced block, this third part of the block is reproduced in opposite direction as compared with the reproduction of the second part of the block.

The signal subject to encoding in accordance with the present invention either corresponds to a digital signal or to a residual signal of an analysis filtered digital signal. The signal comprises a sequential pattern which represents sound, such as speech or audio, or any other phenomena that can be represented as a sequential pattern, e.g. a video or an ElectroCardioGram (ECG) signal. Thus, the present invention is applicable to any sequential pattern that can be coded so as to be described by consecutive states that are correlated with each other.

Preferably, the encoding/decoding of the start state uses a coding method which is independent of previous parts of the signal, thus making the block self-contained with respect to information defining the start state. However, when the invention is applied in the LPC residual domain, predictive encoding/decoding is preferably used also for the start state. By the assumption that the quantization noise in the decoded signal prior to the beginning of the start state can be neglected, the error weighting or error feedback filter of a predictive encoder can be started from a zero state. Hereby the self-contained coding of the start state is achieved.

Preferably, the signal block is divided into a set of consecutive intervals and the start state chosen to correspond to one or more consecutive intervals of those intervals that have the highest signal energy. This means that encoding/decoding of the start state can be optimized towards a signal part with relatively high signal energy. In this way an encoding/decoding of the rest of the block is accomplished which is efficient from a perceptual point of view since it can be based on a start state which is encoded/decoded with a high accuracy.

An advantage of the present invention is that it enables the predictive coding to be performed in such way that the coded block will be self-contained with respect to information in the excitation domain, i.e. the coded information will not be correlated with information in any previously encoded block. Consequently, at decoding, the decoding of the encoded block is based on information self-contained in the encoded block. This means that if a packet carrying an encoded block is lost during transmission, the predictive decoding of subsequent encoded blocks in subsequent received packets will not be affected by lost state information in the lost packet.

Thus, the present invention avoids the problem of error propagation that conventional predictive coding/decoding encounter during decoding when a packet carrying an encoded block is lost before reception at the decoding end. Accordingly, a codec applying the features of the present invention will become more robust to packet loss.

Preferably, the start state is chosen so as to be located in the part of the block which is associated with the highest signal power. For example, in a speech signal composed of voiced and unvoiced parts, this implies that the start state will be located well within the voiced part in a block including an unvoiced and a voiced part.

In a speech signal, high correlation exists between signal samples within a voiced part and low correlation between signal samples within an unvoiced part. The correlation in the transition region between an unvoiced part and a voiced part, and vice versa, is minor and difficult to exploit. From a perceptual point of view it is more important to achieve a good waveform matching when reproducing a voiced part of the signal, whereas the waveform matching for an unvoiced part is less important.

Conventional predictive coders operate on the signal representations in the same order as that with which the corresponding signal is produced by the signal source. Thus, any coder state representing the signal at a certain time will be correlated with previous coder states representing earlier parts of the signal. Due to the difficulties of exploiting any correlation during a transition from an unvoiced period to a voiced period, the coder states for conventional predictive coders will during the beginning of a voiced period following such a transition include information which gives a quite poor approximation of the original signal. Consequently, the regeneration of the speech signal at the decoding end will provide a perceptually degraded signal for the beginning of the voiced region.

By placing the start state well within a voiced region of a block, and then encoding/decoding the block from the start state towards the end boundaries, the present invention is able to more fully exploit the high correlation in the voiced region to the benefit for the perception. The transition from unvoiced to highly periodic voiced sound takes a few pitch periods. When placing the start state well within a voiced region of a block, the high bit rate of the start state encoding will be applied in a pitch cycle where high periodicity has been established, rather than in one of the very first pitch cycles of the voiced region.

The above mentioned and further features of, and advantages with, the present invention, will be more fully described from the following description.

DETAILED DESCRIPTION OF THE INVENTION

Figure 1:
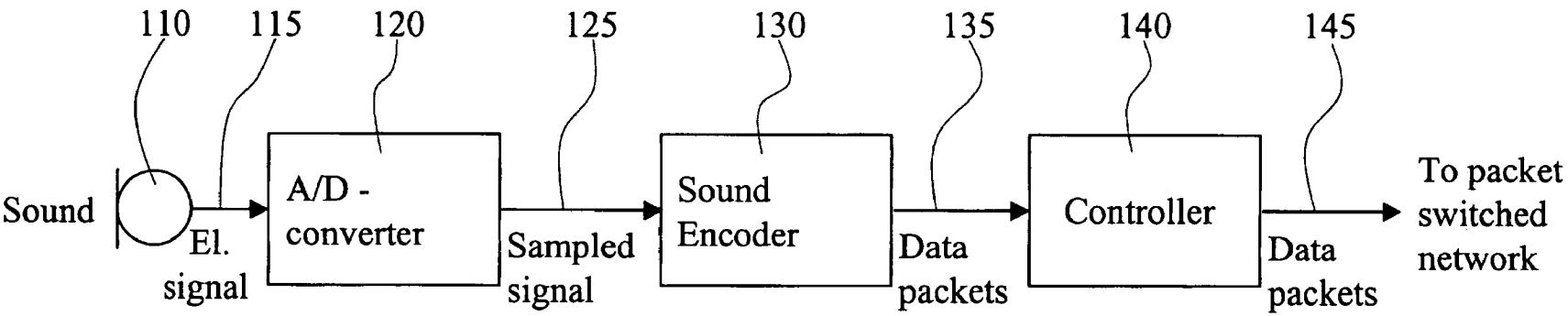
FIG. 1 shows an overview of the transmitting part of a system for transmission of sound over a packet switched network.
Figure 2:
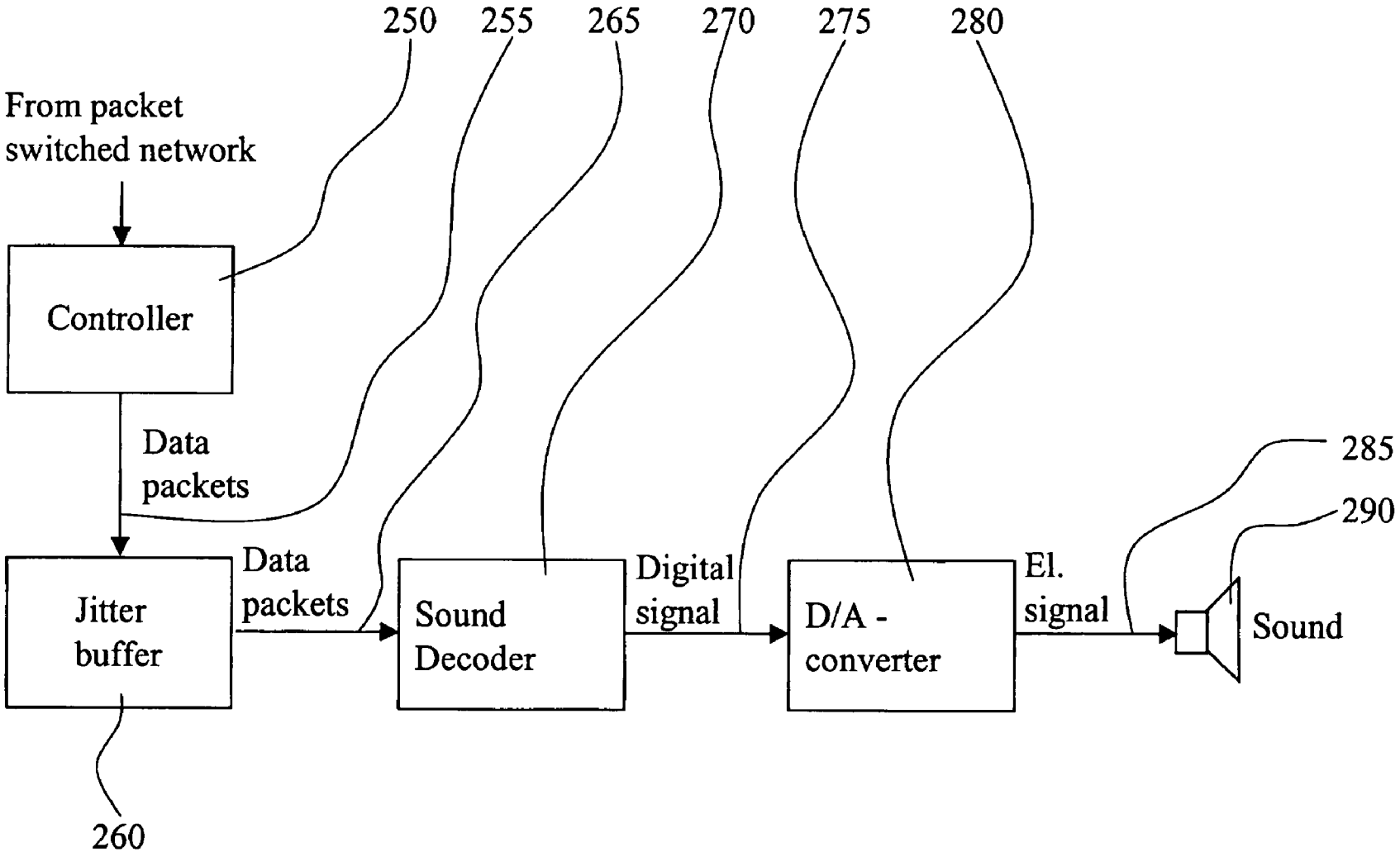
FIG. 2 shows an overview of the receiving part of a system for transmission of sound over a packet switched network.

The encoding and decoding functionality according to the invention is typically included in a codec having an encoder part and a decoder part. With reference to FIGS. 1 and 2, an embodiment of the invention is shown in a system used for transmission of sound over a packet switched network.

In FIG. 1 an encoder 130 operating in accordance with the present invention is included in a transmitting system. In this system the sound wave is picked up by a microphone 110 and transduced into an analog electronic signal 115. This signal is sampled and digitized by an A/D-converter 120 to result in a sampled signal 125. The sampled signal is the input to the encoder 130. The output from the encoder is data packets 135. Each data packet contains compressed information about a block of samples. The data packets are, via a controller 140, forwarded to the packet switched network.

In FIG. 2 a decoder 270 operating in accordance with the present invention is included in a receiving system. In this system the data packets are received from the packet switched network by a controller 250, and stored in a jitter buffer 260. From the jitter buffer data packets 265 are made available to the decoder 270. The output of the decoder is a sampled digital signal 275. Each data packet results in one block of signal samples. The sampled digital signal is input to a D/A-converter 280 to result in an analog electronic signal 285. This signal can be forwarded to a sound transducer 290, containing a loudspeaker, to result in to reproduced sound wave.

The essence of the codec is linear predictive coding (LPC) as is well known from adaptive predictive coding (APC) and code excited linear prediction (CELP). A codec according to the present invention, however, uses a start state, i.e., a sequence of samples localized within the signal block to initialize the coding of the remaining parts of the signal block. The principle of the invention complies with an open-loop analysis-synthesis approach for the LPC as well as the closed-loop analysis-by-synthesis approach, which is well known from CELP. An open-loop coding in a perceptually weighted domain, provides an alternative to analysis-by-synthesis to obtain a perceptual weighting of the coding noise. When compared with analysis-by-synthesis this method provides an advantageous compromise between voice quality and computational complexity of the proposed scheme. The open-loop coding in a perceptually weighted domain is described later in this description.

Encoder

In the embodiment of FIG. 1, the input to the encoder is the digital signal 125. This signal can take the format of 16 bit uniform pulse code modulation (PCM) sampled at 8 kHz and with a direct current (DC) component removed. The input is partitioned into blocks of e.g. 240 samples. Each block is subdivided into, e.g. 6, consecutive sub-blocks of, e.g., 40 samples each.

In principle any method can be used to extract a spectral envelope from the signal block without diverging from the spirit of the invention. One method is outlined as follows: For each input block, the encoder does a number, e.g. two, linear-predictive coding (LPC) analysis, each with an order of e.g. 10. The resulting LPC coefficients are encoded, preferably in the form of line spectral frequencies (LSF). The encoding of LSF's is well known to a person skilled in the art. This encoding may exploit correlations between sets of coefficients, e.g., by use of predictive coding for some of the sets. The LPC analysis may exploit different, and possibly non-symmetric window functions in order to obtain a good compromise between smoothness and centering of the windows and lookahead delay introduced in the coding. The quantized LPC representations can advantageously be interpolated to result in a larger number of smoothly time varying sets of LSF coefficients. Subsequently the LPC residual is obtained using the quantized and smoothly interpolated LSF coefficients converted into coefficients for an analysis filter.

Figure 3:
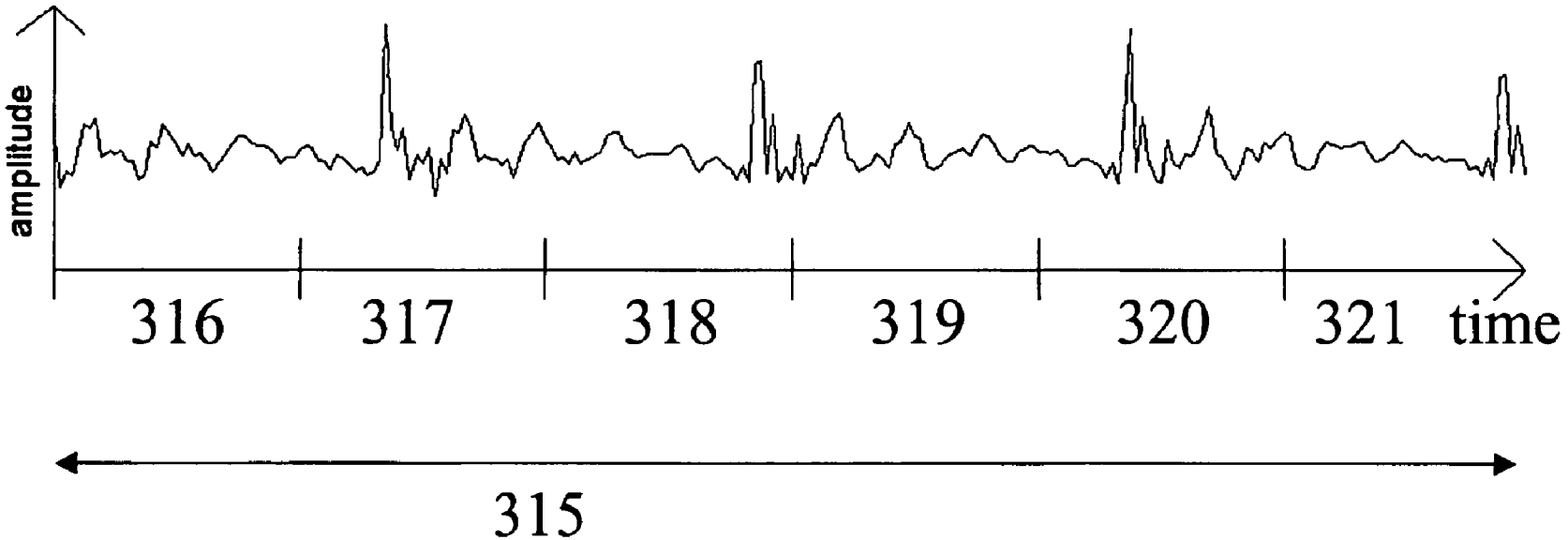
FIG. 3 shows an example of a residual signal block.
Figure 4:
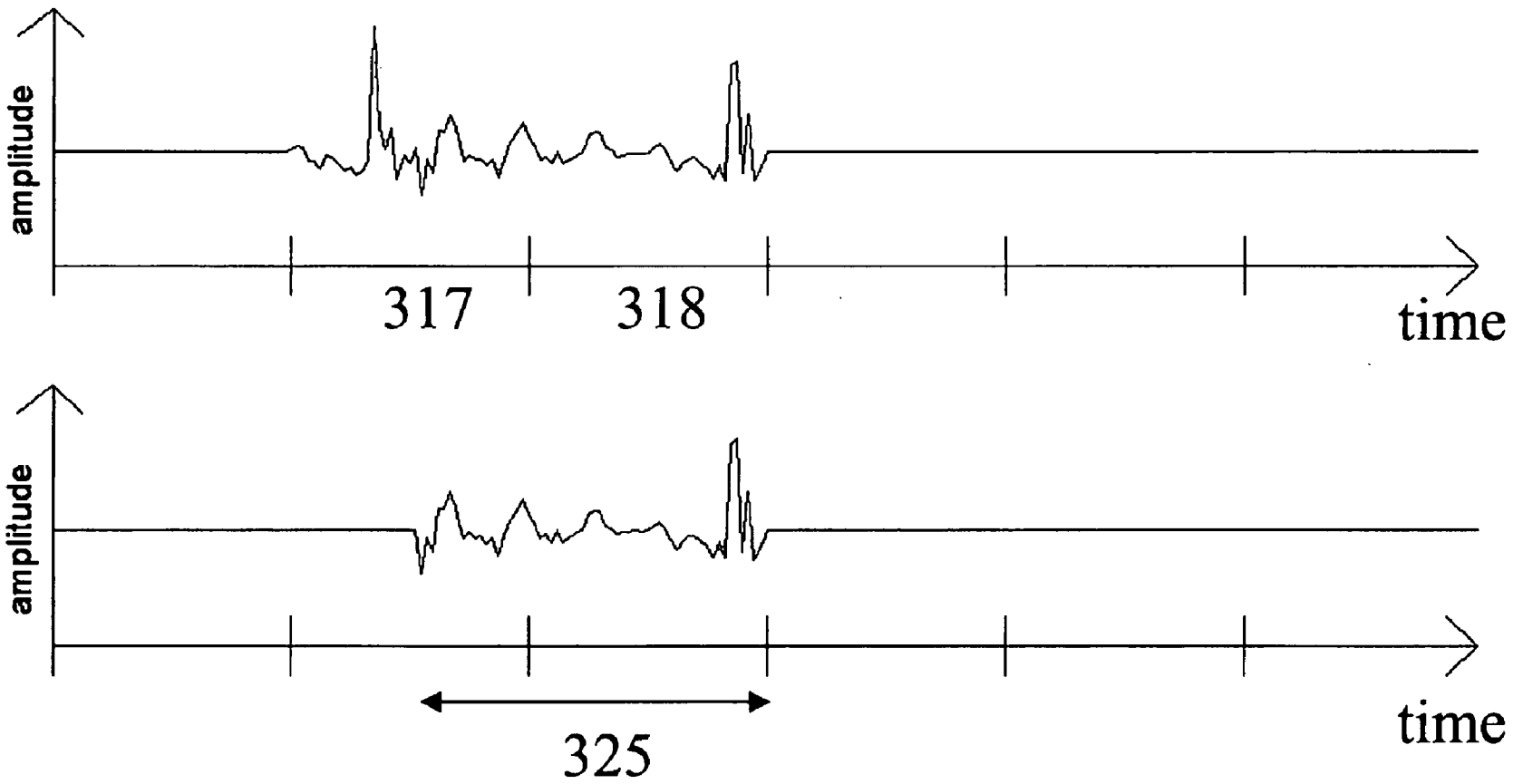
FIG. 4 shows integer sub-block and higher resolution target for start state for the encoding of the residual of FIG. 3.

An example of a residual signal block 315 and its partition into sub-blocks 316, 317, 318, 319, 320 and 321 is illustrated in FIG. 3, the number of sub-blocks being merely illustrative. In this figure each interval on the time axis indicates a sub-block. The identification of a target for a start state within the exemplary residual block in FIG. 3 is illustrated in FIG. 4. In a simple implementation this target can, e.g., be identified as the two consecutive sub-blocks 317 and 318 of the residual exhibiting the maximal energy of any two consecutive sub-blocks within the block. Additionally, the length of the target can be further shortened and localized with higher time resolution by identifying a subset of consecutive samples 325 of possibly predefined length within the two-sub-block interval. Advantageously, such a subset can be chosen as a trailing or tailing predefined number, e.g. 58, of samples within the two-sub-block interval. Again, the choice between trailing or tailing subset can be based on a maximum energy criterion.

Encoding of Start State

Without diverging from the spirit of the invention, the start state can be encoded with basically any encoding method.

Figure 5:
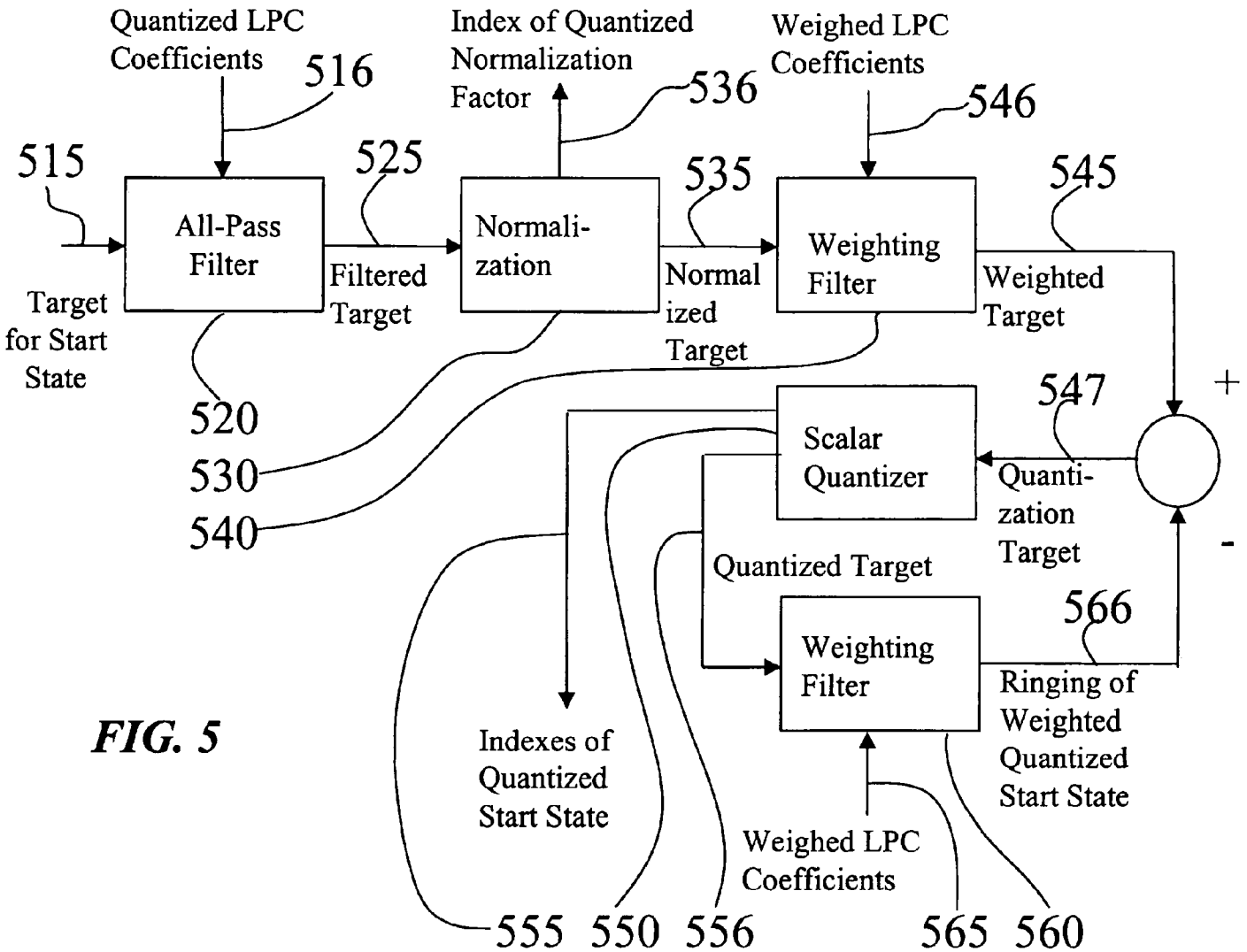
FIG. 5 shows a functional block diagram of an encoder encoding a start state in accordance with an embodiment of the invention.

According to an embodiment of the invention scalar quantization with predictive noise shaping is used, as illustrated in FIG. 5. By the invention, the scalar quantization is pre-pended with an all-pass filtering 520 designed to spread the sample energy on all samples in the start state. It has been found that this results in a good tradeoff between overload and granular noise of a low rate bounded scalar quantizer. A simple design of such an all-pass filter is obtained by applying the LPC synthesis filter forwards in time and the corresponding LPC analysis filter backwards in time. To be specific, when the quantized LPC analysis filter is Aq(z), with coefficients 516. Then the all-pass filter 520 is given by Aq(z^-1)/Aq(z). For the inverse operation of this filter in the decoder, encoded LPC coefficients should be used and the filtering should be a circular convolution of the length of the start state. The remaining part of the start state encoder is well known by a person skilled in the art: The filtered target 525 is normalized to exhibit a predefined maximal amplitude by the normalization 530 to result in the normalized target 535 and an index of quantized normalization factor 536. The weighting of the quantization error is divided into a filtering 540 of the normalized target 535 and a filtering 560 of the quantized target 556, from which the ringing, or zero-input response, 545 for each sample is subtracted from the weighted target 545 to result in the quantization target 547, which is input to the quantizer 550. The result is a sequence of indexes 555 of the quantized start state.

Any noise shaping weighting filter 540 and 560 can be applied in this embodiment. Advantageously the same noise shaping is applied in the encoding of the start state as in the subsequent encoding of the remaining signal block, described later. As an example, the noise shaping can be implemented by minimizing the quantization error after weighting it with a weighting filter equal to A(z/L1)/(Aq(z)*A(z/L2)), where A(z) is the unquantized LPC analysis filter after a possible initial bandwidth expansion, Aq(z) is the quantized LPC analysis filter, and L1 and L2 are bandwidth expansion coefficients, which can advantageously be set to L1=0.8 and L2=0.6, respectively. All LPC and weighting coefficients needed in this filtering is in FIG. 5 gathered in the inputs 546 and 565. An alternative with shorter impulse response, useful when the remaining encoding is done with the third alternative method described later, is to set L1=1.0 and L2=0.4.

Below follows a c-code example implementation of a start state encoder

```
void StateSearchW( /* encoding of a state */
float *residual, /* (i) target residual vector, i.e., signal 515 in Fig. 5 */
float *syntDenum, /* (i) lpc coefficients for signals 516, 546 and 565 in Fig. 5*/
float *weightNum, /* (i) weight filter numerator for signals 546 and 565 in Fig. 5 */
float *weightDenum, /* (i) weight filter denuminator for signals 546 and 565
                    in Fig. 5 */
int *idxForMax, /* (o) quantizer index for maximum amplitude, i.e., signal 536
            in Fig.5 */
int *idxVec, /* (o) vector of quantization indexes, i.e., signal 555 in Fig. 5 */
int len /* (i) length of all vectors, e.g., 58 */
);
void AbsQuantW(float *in, float *syntDenum, float *weightNum, float *weightDenum, int
*out, int len) {
    float *target, targetBuf[FILTERORDER+STATE_LEN],
            *syntOut, syntOutBuf[FILTERORDER+STATE_LEN],
            *weightOut, weightOutBuf[FILTERORDER+STATE_LEN],
            toQ, xq;
    int n;
    int index;
    memset(targetBuf, 0, FILTERORDER*sizeof(float));
    memset(syntOutBuf, 0, FILTERORDER*sizeof(float));
    memset(weightOutBuf, 0, FILTERORDER*sizeof(float));
    target = &targetBuf[FILTERORDER];
    syntOut = &syntOutBuf[FILTERORDER];
    weightOut = &weightOutBuf[FILTERORDER];
    for(n=0;n<len;n++){
        if( n==STATE_LEN/2 ){
            syntDenum += (FILTERORDER+1);
            weightNum += (FILTERORDER+1);
            weightDenum += (FILTERORDER+1);
        }
        AllPoleFilter ( &in[n], weightDenum, 1, FILTERORDER );
        /* this function does an all pole filtering of the
           vector in, result is returned in same vector */
        /* this is the filtering 540 in Figure 5 */
        syntOut[n] = 0.0;
        AllPoleFilter ( &syntOut[n], weightDenum, 1, FILTERORDER );
        /* this is the filtering 560 in Figure 5 */
        /* the quantizer */
        toQ = in[n]−syntOut[n]; /* This is the subtraction of signal 566 from
                    signal 545 to result in signal 547 in Figure 5 */
        sort_sq(&xq, &index, toQ, state_sq3, 8);
        /* this function does a scalar quantization */
        /* This is the function 550 in Figure 5 */
        out[n]=index;
```

-continued

```
            syntOut[n] = state_sq3[out[n]];
            AllPoleFilter( &syntOut[n], weightDenum, 1, FILTERORDER );
            /* This updates the weighting filter 560 in Figure 5 for next sample */
        }
}
void StateSearchW(float *residual, float *syntDenum, float *weightNum,
                float *weightDenum, int *idxForMax, int *idxVec, int len){
    float dtmp, maxVal, tmpbuf[FILTERORDER+2*STATE_LEN], *tmp,
        numerator[1+FILTERORDER], foutbuf[FILTERORDER+2*STATE_LEN], *fout;
    int k,utmp;
    int index;
    memset(tmpbuf, 0, FILTERORDER*sizeof(float));
    memset(foutbuf, 0, FILTERORDER*sizeof(float));
    for(k=0; k<FILTERORDER; k++){
        numerator[k]=syntDenum[FILTERORDER-k];
    }
    numerator[FILTERORDER]=syntDenum[0];
    tmp = &tmpbuf[FILTERORDER];
    fout = &foutbuf[FILTERORDER];
    /* from here */
    memcpy(tmp, residual, len*sizeof(float));
    memset(tmp+len, 0, len*sizeof(float));
    ZeroPoleFilter(tmp, numerator, syntDenum, 2*len, FILTERORDER,fout);
    /* this function does an pole-zero filtering of tmp and
        returns the filtered vector in fout */
    for(k=0;k<len;k++){
        fout[k] += fout[k+len];
    }
    /* to here is the the all-pass filtering 520 in Figure 5 */
    maxVal = fout[0];
    for(k=1; k<len; k++){
        if(fout[k]*fout[k] > maxVal*maxVal){
            maxVal = fout[k];
        }
    }
    maxVal=(float)fabs(maxVal);
    if(maxVal < 10.0){
        maxVal = 10.0;
    }
    maxVal = (float)log10(maxVal);
    sort_sq(&dtmp, &index, maxVal, state_frgq, 64);
    /* this function does a sorting of squared values */
    maxVal=state_frgq[index];
    utmp=index;
    *idxForMax=utmp;
    maxVal = (float)pow(10,maxVal);
    maxVal = (float)(4.5)/maxVal;
    for(k=0;k<len;k++){
        fout[k] = maxVal; /* This is the normalization 530 in Figure 5 */
    }
    AbsQuantW(fout,syntDenum,weightNum,weightDenum,idxVec, len);
}
```

Decoding of Start State

Figure 6:
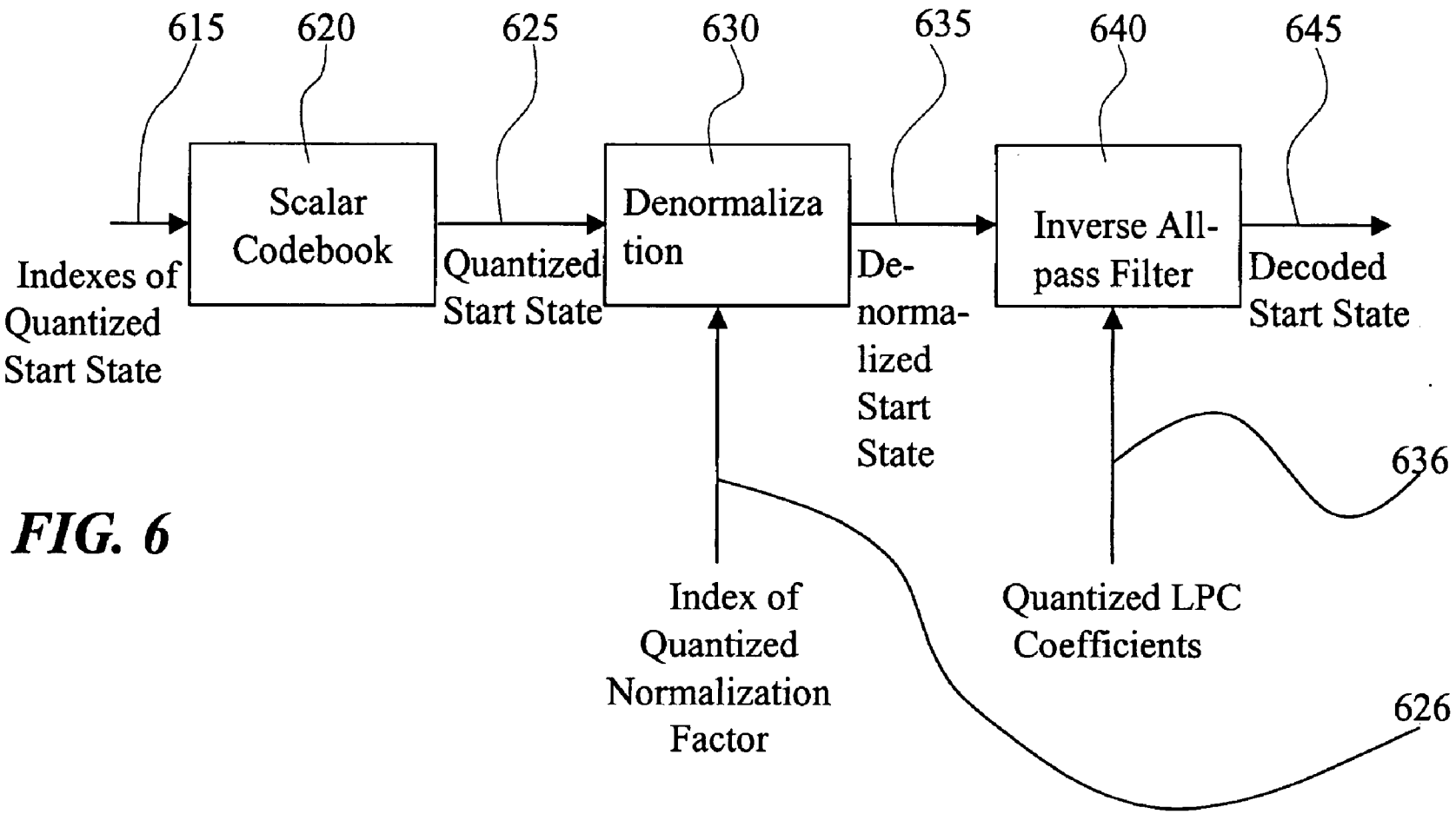
FIG. 6 shows a functional block diagram of a decoder performing a decoding operation corresponding to the encoder in FIG. 5.

The Decoding of the start state follows naturally from the method applied in the encoding of the start state. A decoding method corresponding to the encoding method of FIG. 5 is illustrated in FIG. 6. First the indexes 615 are looked up in the scalar codebook 620 to result in the reconstruction of the quantized start state 625. The quantized start state is then de-normalized 630 using the index of quantized normalization factor 626. This produces the de-normalized start state 635, which is input to the inverse all-pass filter 640, taking coefficients 636, to result in the decoded start state 645. Below follows a c-code example of the decoding of a start state.

```
void StateConstructW( /* decodes one state of speech residual */
            int idxForMax, /* (i) 7-bit index for the quantization of max
                    amplitude, i.e., signal 626 in Fig. 6 */
            int *idxVec, /* (i) vector of quantization indexes,
                    i.e., signal 615 in Fig. 6 */
            float *syntDenum, /* (i) synthesis filter denumerator,
                    i.e., signal 636 in Fig. 6 */
            float *out, /* (o) the decoded state vector,
                    i.e., signal 645 in Fig. 6 */
            int len /* (i) length of a state vector, e.g., 58 */
)
```

-continued

```
{
    float maxVal, tmpbuf[FILTERORDER+2*STATE_LEN], *tmp, numerator[FILTERORDER+1];
    float foutbuf[FILTERORDER+2*STATE_LEN], *fout;
    int     k,tmpi;
    maxVal = state_frgq[idxForMax];
    maxVal = (float)pow(10,maxVal)/(float)4.5;
    memset(tmpbuf, 0, FILTERORDER*sizeof(float));
    memset(foutbuf, 0, FILTERORDER*sizeof(float));
    for(k=0; k<FILTERORDER; k++){
        numerator[k]=syntDenum[FILTERORDER-k];
    }
    numerator[FILTERORDER]=syntDenum[0];
    tmp = &tmpbuf[FILTERORDER];
    fout = &foutbuf[FILTERORDER];
    for(k=0; k<len; k++){
        tmpi = len-1-k;
        tmp[k] = maxVal*state_sq3[idxVec[tmpi]]; /* This is operations 620 and
                                                    630 in Figure 6 */
    }
    /* from here */
    memset(tmp+len, 0, len*sizeof(float));
    ZeroPoleFilter(tmp, numerator, syntDenum, 2*len, FILTERORDER, fout);
    for(k=0;k<len;k++){
        Out[k] = fout[len-1-k]+fout[2*len-1-k];
    }
    /* to here is the operation 640 in Figure 6 */
}
```

Encoding from the Start State Towards the Block Boundaries

Within the scope of the invention the remaining samples of the block can be encoded in a multitude of ways that all exploit the start state as an initialization for the state of the encoding algorithm. Advantageously, a linear predictive algorithm can be used for the encoding of the remaining samples. In particular, the application of an adaptive codebook enables an efficient exploitation of the start state during voiced speech segments. In this case, the encoded start state is used to populate the adaptive codebook. Also an initialization of the state for error weighting filters is advantageously done using the start state. The specifics of such initializations can be done in a multitude of ways well known by a person skilled in the art.

Figure 7:
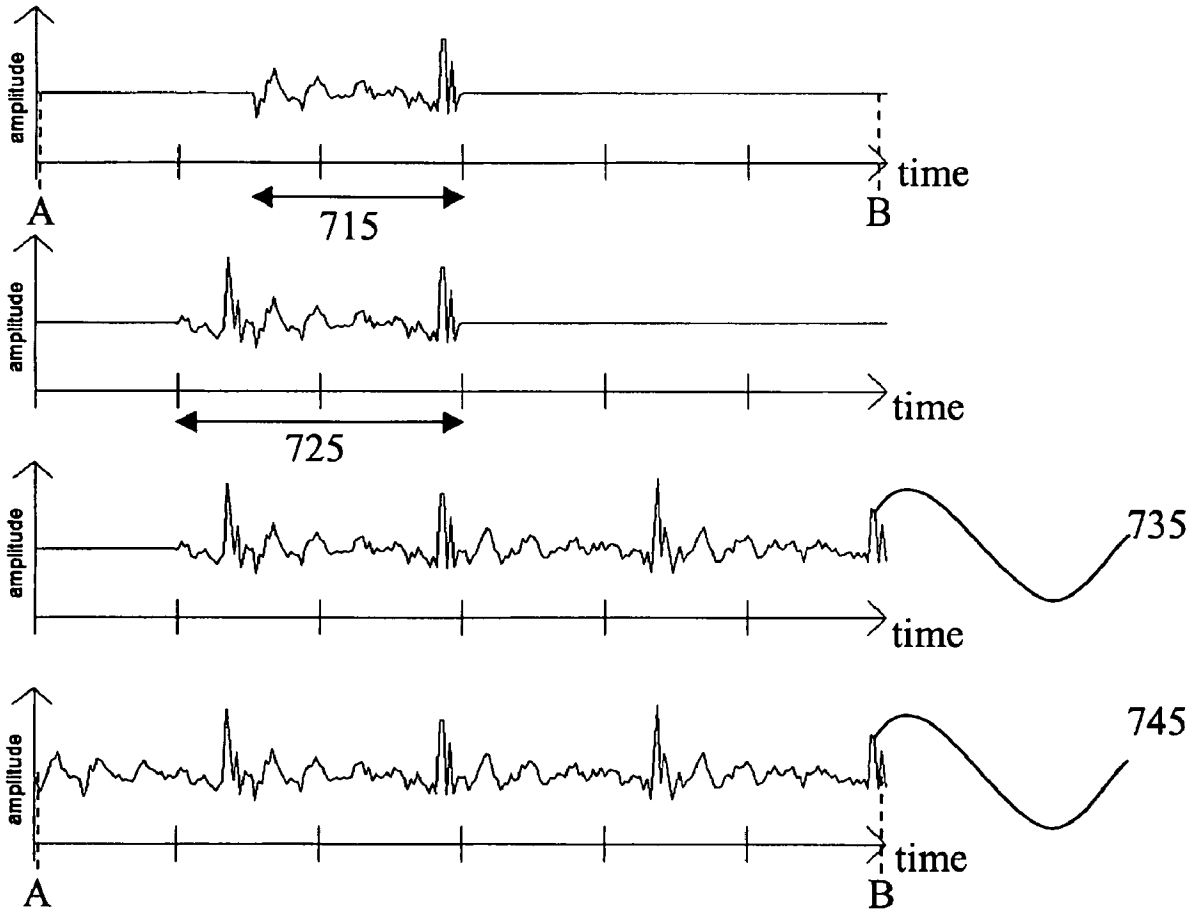
FIG. 7 shows the encoding of a signal from the start state towards the block end boundaries.

The encoding from the start state towards the block boundaries is exemplified by the signals in FIG. 7.

In an embodiment based on sub-blocks for which the start state is identified as an interval of a predefined length towards one end of an interval defined by a number of sub-blocks, it is advantageous to first apply the adaptive codebook algorithm on the remaining interval to reach encoding of the entire interval defined by a number of sub-blocks. As example, the start state 715, which is an example of the signal 645 and which is a decoded representation of the start state target 325, is extended to an integer sub-block length start state 725. Thereafter, these sub-blocks are used as start state for the encoding of the remaining sub-blocks within the block A-B (the number of sub-blocks being merely illustrative).

This encoding can start by either encoding the sub-blocks later in time, or by encoding the sub-blocks earlier in time. While both choices are readily possible under the scope of the invention, we describe in detail only embodiments which start with the encoding of sub-blocks later in time.

Encoding of Sub-Blocks Later in Time

If the block contains sub-blocks later in time of the ones encoded for start state, then an adaptive codebook and weighting filter are initialized from the start state for encoding of sub-blocks later in time. Each of these sub-blocks are subsequently encoded. As an example, this can result in the signal 735 in FIG. 7.

If more than one sub-block is later in time than the integer sub-block start state within the block, then the adaptive codebook memory is updated with the encoded LPC excitation in preparation for the encoding of the next sub-block. This is done by methods which are well known by a person skilled in the art.

Encoding of Sub-Blocks Earlier in Time

If the block contains sub-blocks earlier in time than the ones encoded for the start state, then a procedure equal to the one applied for sub-blocks later in time is applied on the time-reversed block to encode these sub-blocks. The difference is, when compared to the encoding of the sub-blocks later in time, that now not only the start state, but also the LPC excitation later in time than the start state, is applied in the initialization of the adaptive codebook and the perceptual weighting filter. As an example, this will extend the signal 735 into a full decoded representation 745, which is the resulting decoded representation of the LPC residual 315. The signal 745 constitute the LPC excitation for the decoder.

The encoding steps of the present invention have been exemplified on a block of speech LPC residual signal in FIGS. 3 to 5. However, these steps also apply to other signals, e.g., an unfiltered sound signal in the time domain or a medical signal such as EKG, without diverging from the general idea of the present invention.

Example C-Code for the Encoding from the Start State Towards Block Boundaries

```
void iLBC_encode( /* main encoder function */
        float *speech, /* (i) speech data vector */
        unsigned char *bytes, /* (o) encoded data bits */
        float *block, /* (o) decoded speech vector */
        int mode, /* (i) 1 for standard encoding 2 for redundant encoding */
        float *decresidual, /* (o) decoded residual prior to gain adaption
        (useful for a redundant encoding unit) */
        float *syntdenum, /* (o) decoded synthesis filters (useful for a
                    redundant encoding unit) */
        float *weightnum, /* (o) weighting numerator (useful for a redundant
                    encoding unit) */
        float *weightdenum /* (o) weighting denumerator (useful for a
                     redundant encoding unit) */
)
{
    float data[BLOCKL];
    float residual[BLOCKL], reverseResidual[BLOCKL];
    float weightnum[NSUB*(FILTERORDER+1)], weightdenum[NSUB*(FILTERORDER+1)];
    int start, idxForMax, idxVec[STATE_LEN];
    float reverseDecresidual[BLOCKL], mem[MEML];
    int n, k, kk, meml_gotten, Nfor, Nback, i;
    int dummy=0;
    int gain_index[NSTAGES*NASUB], extra_gain_index[NSTAGES];
    int cb_index[NSTAGES*NASUB], extra_cb_index[NSTAGES];
    int lsf_i[LSF_NSPLIT*LPC_N];
    unsigned char *pbytes;
    int diff, start_pos, state_first;
    float en1, en2;
    int index, gc_index;
    int subcount, subframe;
    float weightState[FILTERORDER];
    memcpy(data,block,BLOCKL*sizeof(float));
    /* LPC of input data */
    LPCencode(syntdenum, weightnum, weightdenum, lsf_i, data);
    /* This function does LPC analysis and quantization and smooth
       interpolation of the LPC coefficients */
    /* Inverse filter to get residual */
    for (n=0; n<NSUB; n++ ) {
        anaFilter(&data[n*SUBL], &syntdenum[n*(FILTERORDER+1)], SUBL,
        &residual[n*SUBL]);
    }
    /* This function does an LPC analysis filtering using the
       quantized and interpolated LPC coefficients */
    /* At this point residual is the signal of which signal 315
       in Figure 3 is an example */
    /* find state location */
    start = FrameClassify(residual);
       /* This function localizes the start state with resolution of
       integer sub frames */
       /* The variable start indicates the beginning of the
         signal 317,318 (Figure 4) in integer number of subblocks */
    /* Check if state should be in first or last part of the two subframes */
    diff = STATE_LEN - STATE_SHORT_LEN;
    en1 = 0;
    index = (start-1)*SUBL;
    for (i=0; i < STATE_SHORT_LEN; i++) en1 +=
                                residual[index+i]*residual[index+i];
    en2 = 0;
    index = (start-1)*SUBL+diff;
    for (i = 0; i < STATE_SHORT_LEN; i++) en2 +=
                                residual[index+i]*residual[index+i];
    if (en1 > en2) {
        state_first = 1;
        start_pos = (start-1)*SUBL;
    } else {
        state_first = 0;
        start_pos = (start-1)*SUBL + diff;
    }
    /* The variable start_pos now indicates the beginning of the
       signal 325 (Figure 4) in integer number of samples */
    /* scalar quantization of state */
    StateSearchW(&residual[start_pos], &syntdenum[(start-1)*(FILTERORDER+1)],
            &weightnum[(start-1)*(FILTERORDER+1)],
            &weightdenum[(start-1)*(FILTERORDER+1)], &idxForMax,
            idxVec, STATE_SHORT_LEN);
```

-continued

```
/* This function encodes the start state (specified earlier in
   this description */
StateConstructW(idxForMax, idxVec, &syntdenum[(start−1)*(FILTERORDER+1)],
            &decresidual[start__pos], STATE__SHORT__LEN);
/* This function decodes the start state */
/* At this point decresidual contains the signal of which signal 715 in figure 7
   is an example */
/* predictive quantization in state */
if (state__first) { /* Put adaptive part in the end */
      /* Setup memory */
      memset(mem, 0, (MEML−STATE__SHORT__LEN)*sizeof(float));
      memcpy(mem+MEML−STATE__SHORT__LEN, decresidual+start__pos,
      STATE__SHORT__LEN*sizeof(float));
      memset(weightState, 0, FILTERORDER*sizeof(float));
      /* Encode subframes */
      iCBSearch(extra__cb__index, extra__gain__index,
            &residual[start__pos+STATE__SHORT__LEN],
            mem+MEML−stMemL, stMemL, diff, NSTAGES,
            &syntdenum[(start−1)*(FILTERORDER+1)],
           &weightnum[(start−1)*(FILTERORDER+1)],
           &weightdenum[(start−1)*(FILTERORDER+1)], weightState
           );
      /* This function does a weighted multistage search of shape and gain
         indexes */
      /* construct decoded vector */
      iCBConstruct(&decresidual[start__pos+STATE__SHORT__LEN],
                extra__cb__index, extra__gain__index,mem+MEML−stMemL,
                 stMemL, diff, NSTAGES);
      /* This function decodes the multistage encoding */
}
else {/* Put adaptive part in the beginning */
      /* create reversed vectors for prediction */
      for(k=0; k<diff; k++ ){
            reverseResidual[k] = residual[(start+1)*SUBL −1−
                              (k+STATE__SHORT__LEN)];
            reverseDecresidual[k] = decresidual[(start+1)*SUBL −1−
                              (k+STATE__SHORT__LEN)];
      }
      /* Setup memory */
      meml__gotten = STATE__SHORT__LEN;
      for( k=0; k<meml__gotten; k++){ mem[MEML−1−k] =
                              decresidual[start__pos + k]; }
      memset(mem, 0, (MEML−k)*sizeof(float));
      memset(weightState, 0, FILTERORDER*sizeof(float));
      /* Encode subframes */
      iCBSearch(extra__cb__index, extra__gain__index, reverseResidual,
            mem+MEML−stMemL, stMemL, diff, NSTAGES,
            &syntdenum[(start−1)*(FILTERORDER+1)],
            &weightnum[(start−1)*(FILTERORDER+1)],
            &weightdenum[(start−1)*(FILTERORDER+1)], weightState
           );
      /* construct decoded vector */
      iCBConstruct(reverseDecresidual, extra__cb__index, extra__gain__index,
             mem+MEML−stMemL, stMemL, diff, NSTAGES);
      /* get decoded residual from reversed vector */
      for( k=0; k<diff; k++ ){
            decresidual[start__pos−1−k] = reverseDecresidual[k];
      }
}
/* At this point decresidual contains the signal
   of which signal 725 in Figure 7 is an example */
/* counter for predicted subframes */
subcount=0;
/* forward prediction of subframes */
Nfor = NSUB−start−1;
if( Nfor > 0 ){
      /* Setup memory */
      memset(men, 0, (MEML−STATE__LEN)*sizeof(float));
      memcpy(mem+MEML−STATE__LEN, decresidual+(start−1)*SUBL,
            STATE__LEN*sizeof(float));
      memset(weightState, 0, FILTERORDER*sizeof(float));
      /* Loop over subframes to encode */
      for (subframe=0; subframe<Nfor; subframe++) {
            /* Encode subframe */
            iCBSearch(cb__index+subcount*NSTAGES,
                  gain__index+subcount*NSTAGES,
                  &residual[(start+1+subframe)*SUBL],
                  mem+MEML−memLf[subcount], memLf[subcount], SUBL,
                   NSTAGES,
```

-continued

```
                &syntdenum[(start+1+subframe)*(FILTERORDER+1)],
                &weightnum[(start+1+subframe)*(FILTERORDER+1)],
                &weightdenum[(start+1+subframe)*(FILTERORDER+1)],
                weightState);
            /* construct decoded vector */
            iCBConstruct(&decresidual[(start+1+subframe)*SUBL],
                cb_index+subcount*NSTAGES, gain_index+subcount*NSTAGES,
                mem+MEML−memLf[subcount], memLf[subcount], SUBL,
                NSTAGES);
            /* Update memory */
            memcpy(mem, mem+SUBL, (MEML−SUBL)*sizeof(float));
            memcpy(mem+MEML−SUBL, &decresidual[(start+1+subframe)*SUBL],
                SUBL*sizeof(float));
            memset(weightState, 0, FILTERORDER*sizeof(float));
            subcount++;
        }
    }
    /* At this point decresidual contains the signal
    of which signal 735 in Figure 7 is an example */
    /* backward prediction of subframes */
    Nback = start−1;
    if( Nback > 0 ){
        /* Create reverse order vectors */
        for( n=0; n<Nback; n++ ){
            for( k=0; k<SUBL; k++ ){
                reverseResidual[n*SUBL+k] =
                    residual[(start−1)*SUBL−1−n*SUBL−k];
                reverseDecresidual[n*SUBL+k] =
                    decresidual[(start−1)*SUBL−1−n*SUBL−k];
            }
        }
        /* Setup memory */
        meml_gotten = SUBL*(NSUB+1−start);
        if( meml_gotten > MEML ){ meml_gotten=MEML; }
        for( k=0; k<meml_gotten; k++){ mem[MEML−1−k] =
                    decresidual[(start−1)*SUBL + k]; }
        memset(mem, 0, (MEML−k)*sizeof(float));
        memset(weightState, 0, FILTERORDER*sizeof(float));
        /* Loop over subframes to encode */
        for (subframe=0; subframe<Nback; subframe++) {
            /* Encode subframe */
            iCBSearch (cb_index+subcount*NSTAGES,
                gain_index+subcount*NSTAGES,
                &reverseResidual[subframe*SUBL],
                mem+MEML−memLf[subcount], memLf[subcount],
                SUBL, NSTAGES,
                &syntdenum[(start−1−subframe)*(FILTERORDER+1)],
                &weightnum[(start−1−subframe)*(FILTERORDER+1)],
                &weightdenum[(start−1−subframe)*(FILTERORDER+1)],
                weightState);
            /* construct decoded vector */
            iCBConstruct(&reverseDecresidual[subframe*SUBL],
                cb_index+subcount*NSTAGES, gain_index+subcount*NSTAGES,
                mem+MEML−memLf[subcount], memLf[subcount],
                SUBL, NSTAGES);
            /* Update memory */
            memcpy(mem, mem+SUBL, (MEML−SUBL)*sizeof(float));
            memcpy(mem+MEML−SUBL, &reverseDecresidual[subframe*SUBL],
                SUBL*sizeof(float));
            memset(weightState, 0, FILTERORDER*sizeof(float));
            subcount++;
        }
        /* get decoded residual from reversed vector */
        for (i = 0; i < SUBL*Nback; i++)
            decresidual[SUBL*Nback − i − 1] = reverseDecresidual[i];
    }
    /* At this point decresidual contains the signal
    of which signal 745 in Figure 7 is an example */
.. packing information into bytes
}
```

Weighted Adaptive Codebook Search

In the described forward and backward encoding procedures. The adaptive codebook search can be done in an un-weighted residual domain, or a traditional analysis-by-synthesis weighting can be applied. We here describe in detail a third method applicable to adaptive codebooks. This method supplies an alternative to analysis-by-synthesis, and gives a good compromise between performance and computational complexity. The method consist of a pre-weighting of the adaptive codebook memory and the target signal prior to construction of the adaptive codebook and subsequent search for the best codebook index.

The advantage of this method, compared to analysis-by-synthesis, is that the weighting filtering on the codebook memory leads to less computations than what is needed in the zero state filter recursion of an analysis-by-synthesis encoding for adaptive codebooks. The drawback of this method is that the weighted codebook vectors will have a zero-input component which results from past samples in the codebook memory not from past samples of the decoded signal as in analysis-by-synthesis. This negative effect can be kept low by designing the weighting filter to have low energy in the zero input component relative to the zero state component over the length of a codebook vector. Advantageous parameters for a weighting filter of the form A(z/L1)/(Aq(z)*A(z/L2)), is to set L1=1.0 and L2=0.4.

Figure 8:
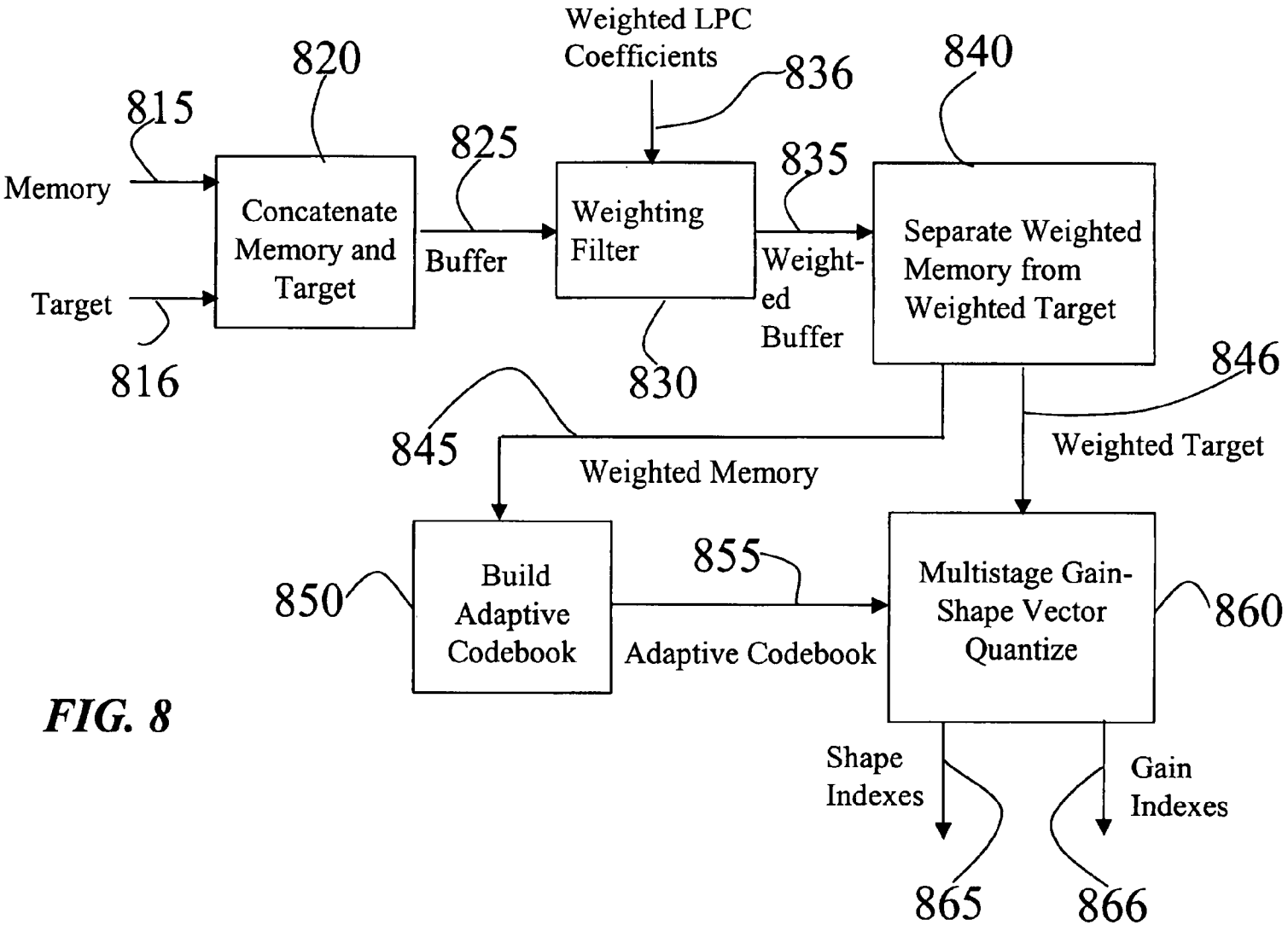
FIG. 8 shows a functional block diagram of an adaptive codebook search advantageously exploited by an embodiment of the present invention.

An implementation of this third method is schematized in FIG. 8. First the adaptive codebook memory 815 and the quantization target 816 are concatenated in time 820 to result in a buffer 825. This buffer is then weighting filtered 830 using the weighted LPC coefficients 836. The Weighted buffer 835 is then separated 840 into the time samples corresponding to the memory and those corresponding to the target. The weighted memory 845 is then used to build the adaptive codebook 850. As is well known by a person skilled in the art, the adaptive codebook 855 need not differ in physical memory location from the weighted memory 845 since time shifted codebook vectors can be addressed the same way as time shifted samples in the memory buffer.

Below follows a c-code example implementation of this third method for weighted codebook search.

```
void iCBSearch( /* adaptive codebook search */
        int *index, /* (o) vector lindexes. This is signal 865 on Fig. 8 */
        int *gain__index, /* (o) vector gain indexes.
                This is signal 866 on Fig. 8 */
            float *target, /* (i) quantization target.
                This is signal 816 on Fig. 8 */
        float *mem, /* (i) memory for adaptive codebook.
                This is signal 815 on Fig. 8 */
        int lMem, /* (i) length of memory */
        int lTarget, /* (i) length of target vector */
        int nStages, /* (i) number of quantization stages */
        float *weightDenum, /* (i) weighting filter denumerator coefficients.
                This is signal 836 on Fig. 8 */
        float *weightState /* (i) state of the weighting filter for the target
                filtering. This is state for the filtering 830
                on Fig. 8 */
)
{
    int i, j, icount, stage, best__index;
    float max__measure, gain, measure, crossDot, invDot;
    float gains[NSTAGES];
    float cb[(MEML+SUBL+1)*CBEXPAND*SUBL];
    int base__index, sInd, eInd, base__size;
    /* for the weighting */
    float buf[MEML+SUBL+2*FILTERORDER];
    base__size=lMem−lTarget+1;
    if (lTarget==SUBL)
        base__size=lMem−lTarget+1+lTarget/2;
    memcpy(buf,weightState,sizeof(float)*FILTERORDER);
    memcpy(&buf[FILTERORDER],mem,lMem*sizeof(float));
    memcpy(&buf[FILTERORDER+lMem],target,lTarget*sizeof(float));
    /* At this point buf is the signal 825 on Fig. 8 */
    AllPoleFilter(&buf[FILTERORDER], weightDenum, lMem+lTarget, FILTERORDER);
     /* this function does an all pole filtering of buf. The result is returned in
       buf. This is the function 830 on Fig. 8 */
    /* At this point buf is the signal 835 on Fig. 8 */
    /* Construct the CB and target needed */
    createCB(&buf[FILTERORDER], cb, lMem, lTarget);
    memcpy(target,&buf[FILTERORDER+lMem], lTarget*sizeof(float));
    /* At this point target is the Signal 846 on Fig. 8
       and cb is the signal 855 on Fig. 8 */
    /* The Main Loop over stages */
    /* This loop does the function 860 on Fig. 8 */
    for (stage=0;stage<nStages; stage++) {
        max__measure = (float)−10000000.0;
        best__index = 0;
        for (icount = 0; icount<base__size; icount++) {
            crossDot=0.0;
            invDot=0.0;
            for (j=0;j<lTarget;j++) {
```

-continued

```
            crossDot += target[j]*cb[icount*lTarget+j];
            invDot += cb[icount*lTarget+j]*cb[icount*lTarget+j];
        }
        invDot = (float)1.0/(invDot+EPS);
        if (stage==0) {
            measure=(float)-10000000.0;
            if (crossDot > 0.0)
                measure = crossDot*crossDot*invDot;
        }
        else {
            measure = crossDot*crossDot*invDot;
        }
        if(measure>max_measure){
            best_index = icount;
            max_measure = measure;
            gain = crossDot*invDot;
        }
    }
    base_index=best_index;
    if (RESRANGE == -1) { /* unrestricted search */
        sInd=0;
        eInd=base_size-1;
    }
    else {
        sInd=base_index-RESRANGE/2;
        if (sInd < 0) sInd=0;
        eInd = sInd+RESRANGE;
        if (eInd>=base_size) {
            eInd=base_size-1;
            sInd=eInd-RESRANGE;
        }
    }
    for (i=1; i<CBEXPAND; i++) {
        sInd += base_size;
        eInd += base_size;
        for (icount=sInd; icount<=eInd; icount++) {
            crossDot=0.0;
            invDot=0.0;
            for (j=0;j<lTarget;j++) {
                crossDot += target[j]*cb[icount*lTarget+j];
                invDot +=
                cb[icount*1Target+j]*cb[icount*lTarget+j];
            }
            invDot = (float)1.0/(invDot+EPS);
            if (stage==0) {
                measure=(float)-10000000.0;
                if (crossDot > 0.0)
                    measure = crossDot*crossDot*invDot;
            }
            else {
                measure = crossDot*crossDot*invDot;
            }
            if(measure>max_measure){
                best_index = icount;
                max_measure = measure;
                gain = crossDot*invDot;
            }
        }
    }
    index[stage] = best_index;
    /* index is signal 865 on Fig. 8 */
    /* gain quantization */
    if(stage==0){
        if (gain<0.0) gain = 0.0;
        if (gain>1.0) gain = 1.0;
        gain = gainquant(gain, 1.0, 16, &gain_index[stage]);
        /* This function search the best index for the gain
           quantizations */
        /* gain_index is signal 866 on Fig. 8 */
    }
    else {
        if(fabs(gain) > fabs(gains[stage-1])){
            gain = gain * (float)fabs(
                    gains[stage-1])/(float)fabs(gain);
        }
        gain = gainquant(gain, (float)fabs(gains[stage-1]), 8,
                &gain_index[stage]);
         /* This function search the best index for the gain
            quantizations */
```

-continued

```
            /* gain_index is signal 866 on Fig. 8 */
        }
        /* Update target */
        for(j=0;j<lTarget;j++) target[j] -= gain*cb[index[stage]*lTarget+j];
        gains[stage]=gain;
    }/* end of Main Loop. for (stage=0;... */
}
```

Decoder

The decoder covered by the present invention is any decoder that interoperates with an encoder according to the above description. Such a decoder will extract from the encoded data a location for the start state. It will decode the start state and use it as an initialization of a memory for the decoding of the remaining signal frame. In case a data packet is not received a packet loss concealment could be advantageous.

Below follows a c-code example implementation of a decoder.

```
void iLBC_decode( /* main decoder function */
        float *decblock, /* (o) decoded signal block */
        unsigned char *bytes, /* (i) encoded signal bits */
        int bytes_are_good /* (i) 1 if bytes are good data 0 if not */
){
    float reverseDecresidual[BLOCKL], mem[MEML];
    int n, k, meml_gotten, Nfor, Nback, i;
    int diff, start_pos;
    int subcount, subframe;
    float factor;
    float std_decresidual, one_minus_factor_scaled;
    int gaussstart;
    diff = STATE_LEN - STATE_SHORT_LEN;
    if(state_first == 1) start_pos = (start-1)*SUBL;
    else start_pos = (start-1)*SUBL + diff;
    StateConstructW(idxForMax, idxVec,
            &syntdenum[(start-1)*(FILTERORDER+1)],
            &decresidual[start_pos], STATE_SHORT_LEN);
    /* This function decodes the start state */
    if (state_first) { /* Put adaptive part in the end */
        /* Setup memory */
        memset(mem, 0, (MEML-STATE_SHORT_LEN)*sizeof(float));
        memcpy(mem+MEML-STATE_SHORT_LEN, decresidual+start_pos,
            STATE_SHORT_LEN*sizeof(float));
        /* construct decoded vector */
        iCBConstruct(&decresidual[start_pos+STATE_SHORT_LEN],
                extra_cb_index, extra_gain_index,
                mem+MEML-stMemL, stMemL, diff, NSTAGES);
         /* This function decodes a frame of residual */
    }
    else {/* Put adaptive part in the beginning */
        /* create reversed vectors for prediction */
        for(k=0; k<diff; k++ ){
            reverseDecresidual[k] = decresidual[(start+1)*SUBL -1-
                        (k+STATE_SHORT_LEN)];
        }
        /* Setup memory */
        meml_gotten = STATE_SHORT_LEN;
        for( k=0; k<meml_gotten; k++){ mem[MEML-1-k] = decresidual[start_pos +
                                                                    k]; }
        memset(mem, 0, (MEM-k)*sizeof(float));
        /* construct decoded vector */
        iCBConstruct(reverseDecresidual, extra_cb_index,
                extra_gain_index, mem+MEML-stMemL,
                stMemL, diff, NSTAGES);
        /* get decoded residual from reversed vector */
        for( k=0; k<diff; k++ ){
            decresidual[start_pos-1-k] = reverseDecresidual[k];
        }
    }
    /* counter for predicted subframes */
    subcount=0;
    /* forward prediction of subframes */
    Nfor = NSUB-start-1;
    if( Nfor > 0 ){
        /* Setup memory */
        memset(mem, 0, (MEML-STATE_LEN)*sizeof(float));
        memcpy(mem+MEML-STATE_LEN, decresidual+(start-1)*SUBL,
```

-continued

```
            STATE__LEN*sizeof(float));
        /* Loop over subframes to encode */
        for (subframe=0; subframe<Nfor; subframe++) {
            /* construct decoded vector */
            iCBConstruct(&decresidual[(start+1+subframe)*SUBL],
                cb__index+subcount*NSTAGES, gain__index+subcount*NSTAGES,
                mem+MEML−memLf[subcount], memLf[subcount],
                SUBL, NSTAGES);
            /* Update memory */
            memcpy(mem, mem+SUBL, (MEML−SUBL)*sizeof(float));
            memcpy(mem+MEML−SUBL, &decresidual[(start+1+subframe)*SUBL],
                SUBL*sizeof(float));
            subcount++;
        }
    }
    /* backward prediction of subframes */
    Nback = start−1;
    if( Nback > 0 ){
        /* Create reverse order vectors */
        for( n=0; n<Nback; n++ ){
            for( k=0; k<SUBL; k++ ){
                reverseDecresidual[n*SUBL+k] = decresidual[(start−
                                    1)*SUBL−1−n*SUBL−k];
            }
        }
        /* Setup memory */
        meml__gotten = SUBL*(NSUB+1−start);
        if( meml__gotten > MEML ){ meml__gotten=MEML; }
        for( k=0; k<meml__gotten; k++){ mem[MEML−1−k] = decresidual[(start−
                                1)*SUBL + k]; }
        memset(mem, 0, (MEML−k)*sizeof(float));
        /* Loop over subframes to decode */
        for (subframe=0; subframe<Nback; subframe++) {
            /* Construct decoded vector */
            iCBConstruct(&reverseDecresidual[subframe*SUBL],
                cb__index+subcount*NSTAGES, gain__index+subcount*NSTAGES,
                mem+MEML−memLf[subcount], memLf[subcount],
                SUBL, NSTAGES);
            /* Update memory */
            memcpy(mem, mem+SUBL, (MEML−SUBL)*sizeof(float));
            memcpy(mem+MEML−SUBL, &reverseDecresidual[subframe*SUBL],
             SUBL*sizeof(float));
            subcount++;
        }
        /* get decoded residual from reversed vector */
        for (i = 0; i < SUBL*Nback; i++)
            decresidual[SUBL*Nback − i − 1] = reverseDecresidual[i];
    }
    factor=(float)(gc__index+1)/(float)16.0;
    for(i=0;i<STATE__SHORT__LEN;i++) decresidual[start__pos+i] *= factor;
    factor *= 1.5;
    if (factor < 1.0){
      std__decresidual = 0.0;
      for(i=0;i<BLOCKL;i++) std__decresidual += decresidual[i]*decresidual[i];
      std__decresidual /= BLOCKL;
      std__decresidual = (float)sqrt(std__decresidual);
      one__minus__factor__scaled = (float)sqrt(1−factor*factor)*std__decresidual;
      gaussstart = (int)ceil(decresidual[0]) % (GAUSS__NOISE__L−BLOCKL);
      for(i=0;i<BLOCKL;i++) decresidual[i] +=
                                one__minus__factor__scaled*gaussnoise[gaussstart+i];
    }
}
void iLBC__decode(float *decblock, unsigned char *bytes, int bytes__are__good)
{
    static float old__syntdenum[(FILTERORDER + 1)*NSUB] =    {1,0,0,0,0,0,0,0,0,0,0,
                                                              1,0,0,0,0,0,0,0,0,0,0,
                                                              1,0,0,0,0,0,0,0,0,0,0,
                                                              1,0,0,0,0,0,0,0,0,0,0,
                                                              1,0,0,0,0,0,0,0,0,0,0,
                                                              1,0,0,0,0,0,0,0,0,0,0};
    static int last__lag = 20;
    float data[BLOCKL];
    float lsfunq[FILTERORDER*LPC__N];
    float PLCresidual[BLOCKL], PLC1pc[FILTERORDER + 1];
    float zeros[BLOCKL], one[FILTERORDER + 1];
    int k, kk, i, start, idxForMax;
    int idxVec[STATE__LEN];
    int dummy=0,check;
    int gain__index[NASUB*NSTAGES], extra__gain__index[NSTAGES];
```

-continued

```
    int cb__index[NSTAGES*NASUB], extra__cb__index[NSTAGES];
    int lsf__i[LSF__NSPLIT*LPC__N];
    int state__first, gc__index;
    unsigned char *pbytes;
    float weightnum[(FILTERORDER + 1)*NSUB],weightdenum[(FILTERORDER + 1)*NSUB];
    int order__plus__one;
     if (bytes__are__good) {
          ...extracting parameters from bytes
          SimplelsfUNQ(lsfunq, lsf__i);
          /* This function decodes the LPC coefficients in LSF domain */
         check=LSF__check(lsfunq, FILTERORDER, LPC__N);
          /* This function checks stability of the LPC filter */
         DecoderInterpolateLSF(syntdenum, lsfunq, FILTERORDER);
          /* This function interpolates the LPC filter over the block */
         Decode(decresidual, start, idxForMax, idxVec,
               syntdenum, cb__index, gain__index,
               extra__cb__index, extra__gain__index, state__first,gc__index);
          /* This function is included above */
         /* Preparing the plc for a future loss */
         doThePLC(PLCresidual, PLClpc, 0, decresidual,
                 syntdenum + (FILTERORDER + 1)*(NSUB − 1),
                 NSUB, SUBL, last__lag, start);
          /* This function deals with packet loss concealments */
         memcpy(decresidual, PLCresidual, BLOCKL*sizeof(float));
    } else {
         /* Packet loss conceal */
         memset(zeros, 0, BLOCKL*sizeof(float));
         one[0] = 1;
         memset(one+1, 0, FILTERORDER*sizeof(float));
         start=0;
         doThePLC(PLCresidual, PLClpc, 1, zeros, one, NSUB, SUBL,
               last__lag, start);
         memcpy(decresidual, PLCresidual, BLOCKL*sizeof(float));
         order__plus__one = FILTERORDER + 1;
         for (i = 0; i < NSUB; i++)
              memcpy(syntdenum+(i*order__plus__one)+1, PLClpc+1,
                   FILTERORDER*sizeof(float));
    }
    ... postfiltering of the decoded residual
    for (i=0; i < NSUB; i++)
      syntFilter(decresidual + i*SUBL, syntdenum + i*(FILTERORDER+1), SUBL);
      /* This function does a syntesis filtering of the decoded residual */
      memcpy(decblock,decresidual,BLOCKL*sizeof(float));
      memcpy(old__syntdenum, syntdenum, NSUB*(FILTERORDER+1)*sizeof(float));
}
```

The invention claimed is:

1. A method of encoding a sampled signal which is divided into consecutive blocks, the sampled signal being obtained by transducing a sound wave into an analog electronic signal and sampling of the analog signal, wherein the method includes the following steps applied to a block:

encoding a first part of the block using an encoder, wherein the first part is located somewhere between the two end boundaries of the block, thereby obtaining an encoded start state for the block;

encoding a second part of the block using the encoder and a predictive coding method that is based on said encoded start state and that gradually encodes said second part in the direction of one of said two end boundaries; and determining if there are any signal samples located between said start state and the other one of said two end boundaries, and if so, encoding a third part of the block including these samples using the encoder and a predictive coding method that is based on said encoded start state and that gradually encodes said third part in the direction of said other one of said two end boundaries, whereby said third part, with respect to a time base associated with the block, is encoded in an opposite direction as compared with the encoding of said second part, wherein the step of gradually encoding said third part in the direction of said other one of said two end boundaries starts from a sub-block immediately before the first part of the block and ends at a sub-block at the other one of said two end boundaries.

2. The method as claimed in claim 1, wherein the encoding of said third part is based on, in addition to said encoded start state, at least a part of the encoded second part of the block.

3. The method as claimed in claim 2, wherein said second part is encoded in a direction along said time base towards the one of said two end boundaries that is located at the end of the block.

4. The method as claimed in claim 2, wherein said second part is encoded in a direction which is opposite to said time base and towards the one of said two end boundaries that is located at the beginning of the block.

5. The method as claimed in claim 1, wherein said second part is encoded in a direction along said time base towards the one of said two end boundaries that is located at the end of the block.

6. The method as claimed in claim 1, wherein said second part is encoded in a direction which is opposite to said time base and towards the one of said two end boundaries that is located at the beginning of the block.

7. The method as claimed in claim 1, wherein the encoding of the start state is based on any coding method in which the encoding is independent on, or made to be independent on, any previously encoded parts of the signal.

8. The method as claimed in claim 1, wherein the predictive coding of said second and third parts includes an additional step of synthesis filtering from the excitation domain to the encoded signal domain.

9. The method as claimed in claim 1, wherein said signal is a residual signal of an analysis filtered digital signal.

10. The method as claimed in claim 9, wherein the encoding of the start state is based on predictive encoding with noise shaping, which predictive encoding is made independent on any encoded part of the residual signal that precedes the part of the residual signal corresponding to said first part of the block.

11. The method as claimed in claim 1, wherein the start state is all-pass filtered prior to encoding so as to distribute the energy more evenly among the samples of the start state.

12. The method as claimed in claim 1, wherein the method uses recursive encoding by encoding a sub-block composed of said first part of the block in such way that the same steps as those applied to the block are applied to the sub-block.

13. The method as claimed in claim 1, including partitioning the block into a set of consecutive intervals, wherein the encoding of said first part of the block includes encoding one or more consecutive intervals between the two end boundaries, in order to obtain said encoded start state.

14. The method as claimed in claim 13, wherein said one or more consecutive intervals are chosen among those intervals having the highest signal energy.

15. The method as claimed in claim 1, wherein the encoding of the second and third part is based on any of the following coding methods: Linear Prediction Coding (LPC); Code Excited Linear Prediction (CELP); CELP with one or more adaptive codebook stages; Self Excited Linear Prediction (SELP); or Multi-Pulse Linear Prediction Coding (MP-LPC).

16. The method as claimed in claim 1, wherein the encoding of the second and third part is based on pre-weighting of an adaptive codebook memory and the target signal prior to construction of the adaptive codebook.

17. The method as claimed in claim 1, wherein said signal is a speech signal.

18. The method as claimed in claim 1, wherein said signal is an audio signal.

19. An apparatus for predictive encoding of a signal which is divided into consecutive blocks, wherein the apparatus includes means for performing the steps of the method as claimed in claim 1 on each of said blocks.

20. A non-transitory computer-readable medium storing computer-executable components for predictive encoding of a signal which is divided into consecutive blocks, wherein the computer-executable components performs the steps of the method as claimed in claim 1 on each of said blocks.

21. A method of decoding of an encoded signal, which signal at the encoding end was a sampled signal divided into consecutive blocks before encoding of each block, the sampled signal being obtained by transducing a sound wave into an analog electronic signal and sampling of the analog signal, wherein the method includes the following steps applied to an encoded block for reproducing a corresponding decoded block:

decoding an encoded start state using a decoder for reproducing a start state located somewhere between the two end boundaries of the block to be reproduced;

decoding an encoded second part of the block using the decoder and a predictive decoding method based on said start state for gradually reproducing said second part in the direction of one of said two end boundaries; and determining if the encoded block includes an encoded third part, and if so, decoding the encoded third part of the block using the decoder and a predictive decoding method based on said start state for gradually reproducing said third part in the direction of the other one of said two end boundaries, whereby said third part, with respect to a time base associated with the block, is reproduced in an opposite direction as compared with the reproduction of said second part, wherein the steps of gradually reproducing said third part in the direction of the other one of said two end boundaries starts from a sub-block immediately before the encoded start state of the block and ends at a sub-block at the other one of said two end boundaries.

22. The method as claimed in claim 21, wherein the decoding of said third part is based on, in addition to said start state, at least a part of the decoded second part of the block.

23. The method as claimed in claim 22, wherein said second part is reproduced in a direction along said time base towards the one of said two end boundaries that is located at the end of the block.

24. The method as claimed in claim 22, wherein said second part is reproduced in a direction which is opposite to said time base and towards the one of said two end boundaries that is located at the beginning of the block.

25. The method as claimed in claim 21, wherein said second part is reproduced in a direction along said time base towards the one of said two end boundaries that is located at the end of the block.

26. The method as claimed in claim 21, wherein said second part is reproduced in a direction which is opposite to said time base and towards the one of said two end boundaries that is located at the beginning of the block.

27. The method as claimed in claim 21, wherein the decoding of the start state is based on any decoding method which reproduces the start state independently of any previously reproduced parts of the signal.

28. The method as claimed in claim 21, wherein the decoding of said second and third parts includes an additional step of synthesis filtering from the excitation domain to the decoded signal domain, the synthesis filtering of the second and third parts being performed in the same order as the reproduction of the second and third parts of the block.

29. The method as claimed in claim 21, wherein said signal is a residual signal of an analysis filtered digital signal.

30. The method as claimed in claim 21, wherein the decoding of said first, second and third parts is followed by an additional step of synthesis filtering from the excitation domain to the decoded signal domain, wherein the synthesis filtering of the block is performed in sequential order from the one of said two end boundaries occurring first in time to the other boundary occurring later in time.

31. The method as claimed in claim 29, wherein the decoding of the first part is based on predictive decoding with noise shaping, which decoding reproduces the start state independently of any previously reproduced part of the residual signal that precedes the part of the residual signal corresponding to said start state.

32. The method as claimed in claim 30, wherein the decoding of the first part is based on predictive decoding with noise shaping, which decoding reproduces the start state independently of any previously reproduced part of the residual signal that precedes the part of the residual signal corresponding to said start state.

33. The method as claimed in claim 21, wherein the start state is all-pass filtered after said decoding of said first part so as to further concentrate the energy.

34. The method as claimed in claim 21, wherein the method uses recursive decoding by decoding a sub-block composed of said encoded start state in such way that the same steps as those applied to the block are applied to the sub-block.

35. The method as claimed in claim 21, wherein the decoding of the second and third part is based on any of the following decoding methods: Linear Prediction Coding (LPC); Code Excited Linear Prediction (CELP); CELP with one or more adaptive codebooks; Self Excited Linear Prediction (SELP); or Multi-Pulse Linear Prediction Coding (MP-LPC).

36. The method as claimed in claim 21, wherein said signal is a speech signal.

37. The method as claimed in claim 21, wherein said signal is an audio signal.

38. An apparatus for predictive decoding of an encoded signal, which signal at the encoding end was divided into consecutive blocks before encoding of each block, wherein the apparatus includes means for performing the steps of the method as claimed in claim 21 on each encoded block for reproducing a corresponding decoded block.

39. A non-transitory computer-readable medium storing computer-executable components for predictive decoding of an encoded signal, which signal at the encoding end was divided into consecutive blocks before encoding of each block, wherein the computer-executable components performs the steps of the method as claimed in claim 21 on each encoded block for reproducing a corresponding decoded block.

* * * * *